United States Patent [19]

Rosendall

[11] 4,168,561

[45] Sep. 25, 1979

[54] FLOOR SWEEPER WITH IMPROVED BAIL ASSEMBLY

[75] Inventor: Henry J. Rosendall, Grand Rapids, Mich.

[73] Assignee: Bissell, Inc., Grand Rapids, Mich.

[21] Appl. No.: 907,728

[22] Filed: May 19, 1978

[51] Int. Cl.[2] ..... A47L 11/33

[52] U.S. Cl. ..... 15/42; 15/143 R

[58] Field of Search ..... 15/41–48, 15/143–145

[56] References Cited

U.S. PATENT DOCUMENTS

| | | | |
|---|---|---|---|
| 2,057,181 | 10/1936 | Bloom | 15/41 R |
| 2,216,185 | 10/1940 | Cummins | 15/41 R |
| 3,003,170 | 10/1961 | Lathrop | 15/41 R |
| 3,034,163 | 5/1962 | Stevens et al. | 15/41 R |

FOREIGN PATENT DOCUMENTS

| | | | |
|---|---|---|---|
| 500885 | 2/1939 | United Kingdom | 15/41 R |
| 934388 | 8/1963 | United Kingdom | 15/41 R |

*Primary Examiner*—Edward L. Roberts

*Attorney, Agent, or Firm*—Andrus, Sceales, Starke & Sawall

[57] ABSTRACT

A pair of opposed bail stay members are frictionally mounted to the horizontal bar of a T-bar bail, with the stay members engaging the bail stud. The resultant assembly is inserted up through the central slot of the sweeper top and held in position by friction. The opposed stay members seal the top against penetration of dirt into the sweeper mechanism. The outer ends of the horizontal bail bar are received within slots formed in the end partitions of the sweeper sub-frame. The bail bar ends prevent inward movement of the partitions in the event the latter comes loose from the housing end walls. The opposed stay members form a channel for angular movement of the bail stud and with the channel being formed to provide at least one end detent and a central detent. The stay members are slightly flexible and the channel between detents is slightly narrower than the diameter of the bail stud. The detents themselves are dimensioned to be relatively free of the bail stud when the latter is in a detent position.

20 Claims, 11 Drawing Figures

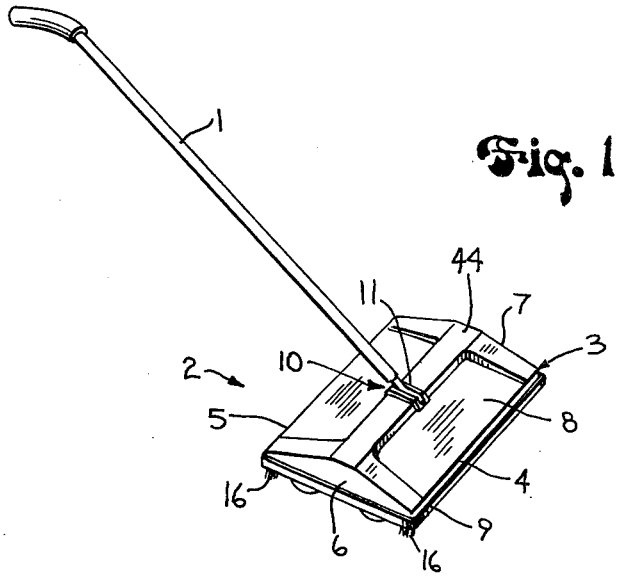
Fig. 1
Fig. 2
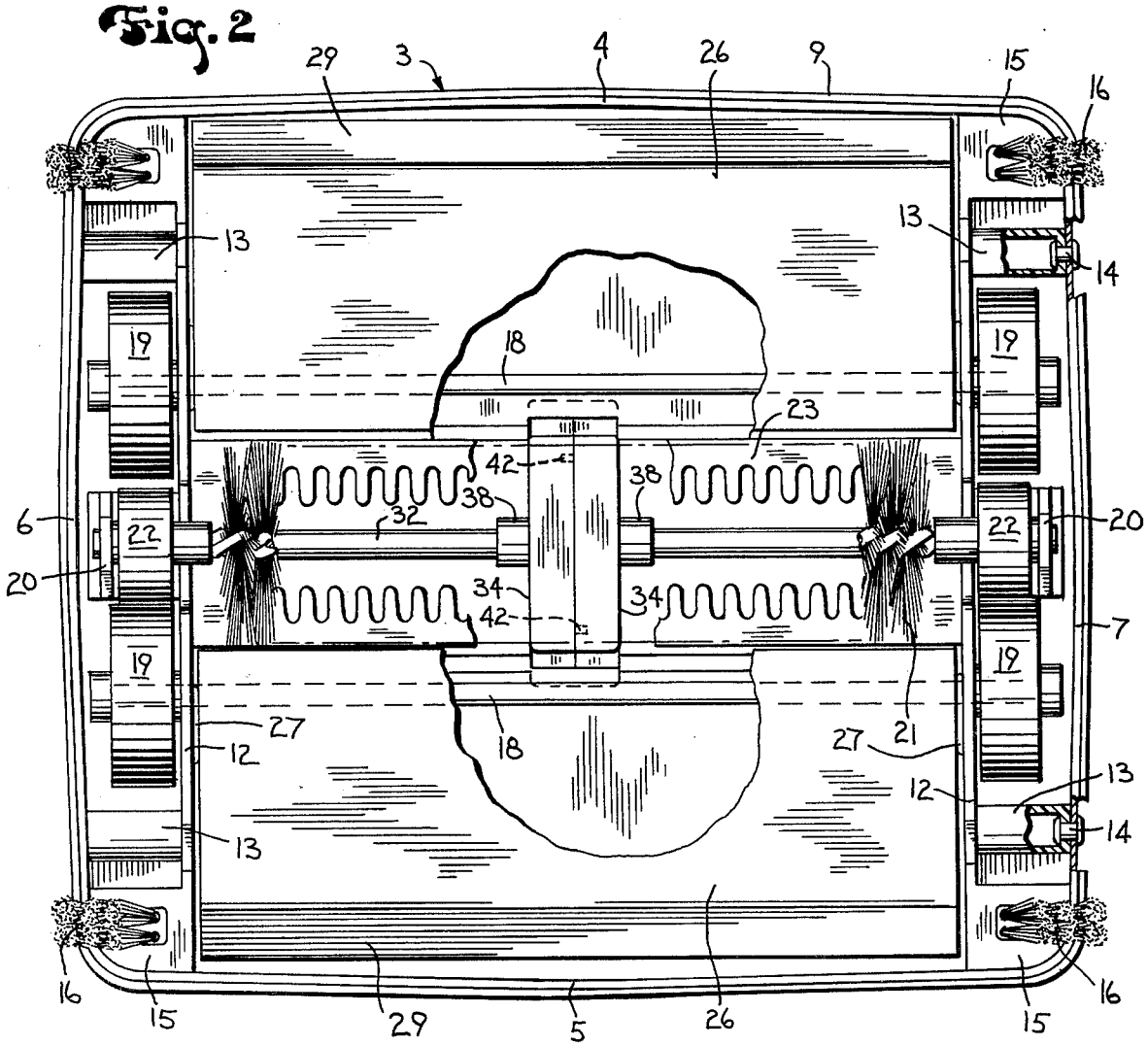

FLOOR SWEEPER WITH IMPROVED BAIL ASSEMBLY

PRIOR ART OF INTEREST

U.S. Pat. Nos. 2,057,181 Bloom Oct. 13, 1936; 3,034,163 Stevens et al May 15, 1962; 3,268,936 Fukuba Aug. 30, 1966.

BACKGROUND AND SUMMARY OF THE INVENTION

This invention relates to a floor sweeper with an improved bail assembly.

It is already known, as in the above-identified patents, to construct a floor sweeper wherein the bail for the handle extends through a slot positioned centrally in the top of the sweeper housing. It is also known that a bail stay may be utilized to hold the bail and handle in a desired end position of maximum tilt or alternately in a central position for storing the sweeper with the handle upright. Furthermore, it has already been proposed, as in the above-identified Bloom patent, to mount the ends of the horizontal bail rod in bearings in the sweeper frame end walls.

In addition, it is also known in floor sweepers to utilize a sub-frame including partitions disposed inwardly from the housing end walls for mounting the sweeper wheels and axles, brush roller, dust pan biasing springs and the like.

It is a task of the present invention to provide a simpler and more economical floor sweeper structure wherein the bail assembly is easily mounted centrally of the sweeper and essentially closes up the central slot to prevent dirt and other debris from penetrating into the sweeper mechanism from the top.

It is a further task of the invention to provide a bail structure which may be readily assembled apart from the sweeper and then quickly mounted therein.

It is yet another task of the invention to provide a bail stay of inexpensive yet simple construction which not only includes central and end detents for handle positioning, but which also co-acts with the bail between detent positions to prevent wobbling of the lower sweeper unit on the handle during sweeping operations.

Other tasks of the invention are to prevent permanent distortion of the bail stay when the handle is in a detent position, and to utilize the bail to prevent inward movement of the frame partitions should the latter become loosened from the housing.

In accordance with one aspect of the invention, a pair of opposed bail stay members are frictionally mounted to the horizontal bar of a T-bar bail, with the stay members engaging the bail stud and prevented from rotating relative to each other on the bar. The resultant assembly is inserted up through the central slot of the sweeper top and held in position by friction and interference. The opposed stay members seal the top against penetration of dirt into the sweeper mechanism.

In accordance with a further aspect of the invention, the outer ends of the horizontal bail bar are received within slots formed in the end partitions of the sweeper sub-frame. The slots prevent shifting of the bail bar laterally. Furthermore, the bail bar ends prevent inward movement of the partitions in the event the latter comes loose from the housing end walls.

In accordance with yet another aspect of the invention, the opposed stay members form a channel for angular movement of the bail stud and with the channel being formed to provide at least one end detent and a central detent. The stay members are slightly flexible and the channel between detents is slightly narrower than the diameter of the bail stud. Thus, when the stud is positioned between detents, the channel edges frictionally bind on the bail stud to substantially reduce wobbling of the sweeper housing on the handle. The detents themselves are dimensioned to be relatively free of the bail stud when the latter is in a detent position to prevent the flexible stay members from taking a permanently expanded set.

BRIEF DESCRIPTION OF THE DRAWINGS

The accompanying drawings furnished herewith illustrate the best mode presently contemplated by the inventor for carrying out the invention.

In the drawings:

FIG. 1 is a perspective view of a floor sweeper embodying the concepts of the invention;

FIG. 2 is a bottom plan view of the sweeper with parts broken away for purposes of clarity;

DESCRIPTION OF THE PREFERRED EMBODIMENT

Figure 3:
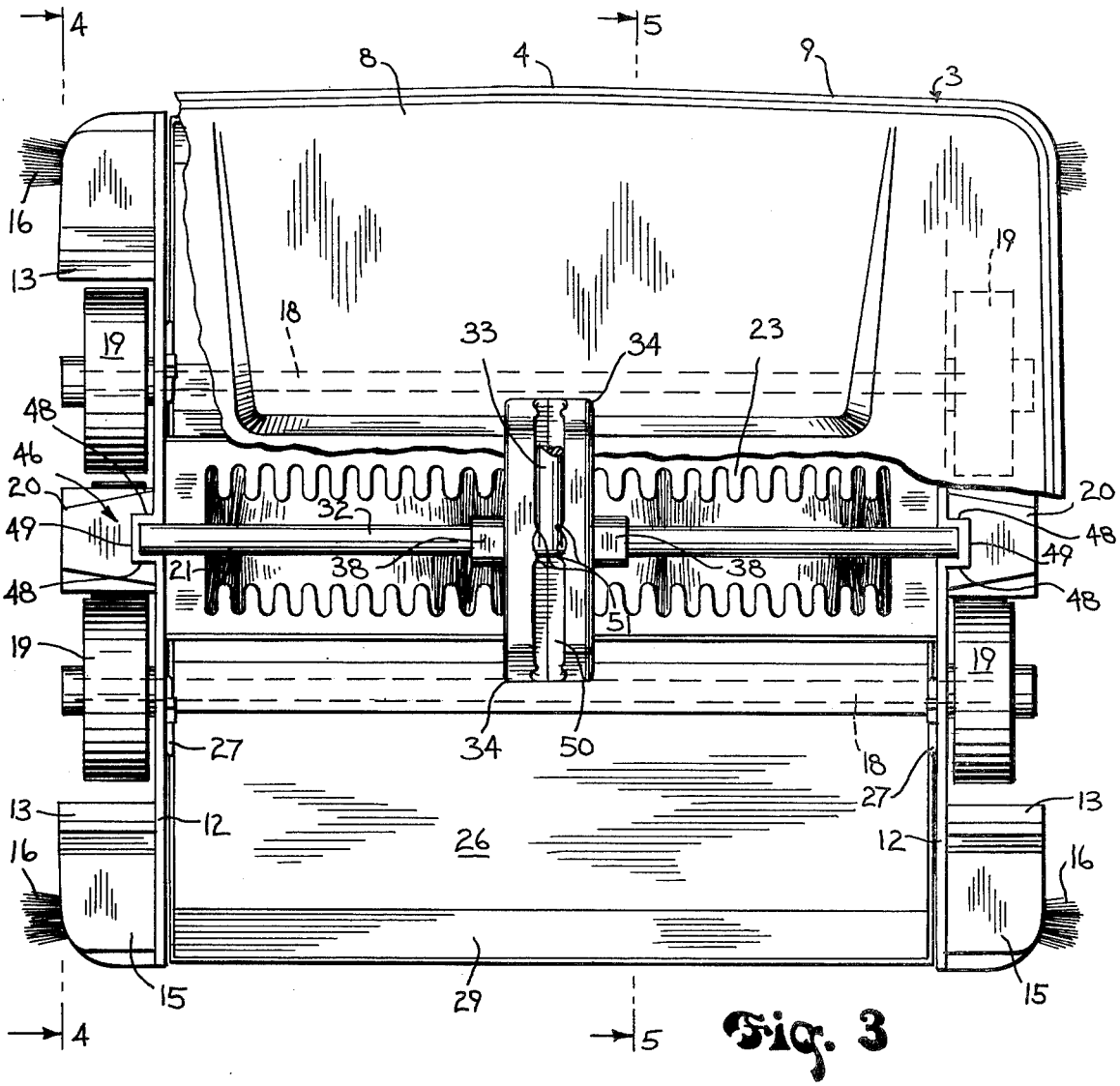
FIG. 3 is a top plan view of the sweeper with a substantial portion of the top removed.
Figure 4:
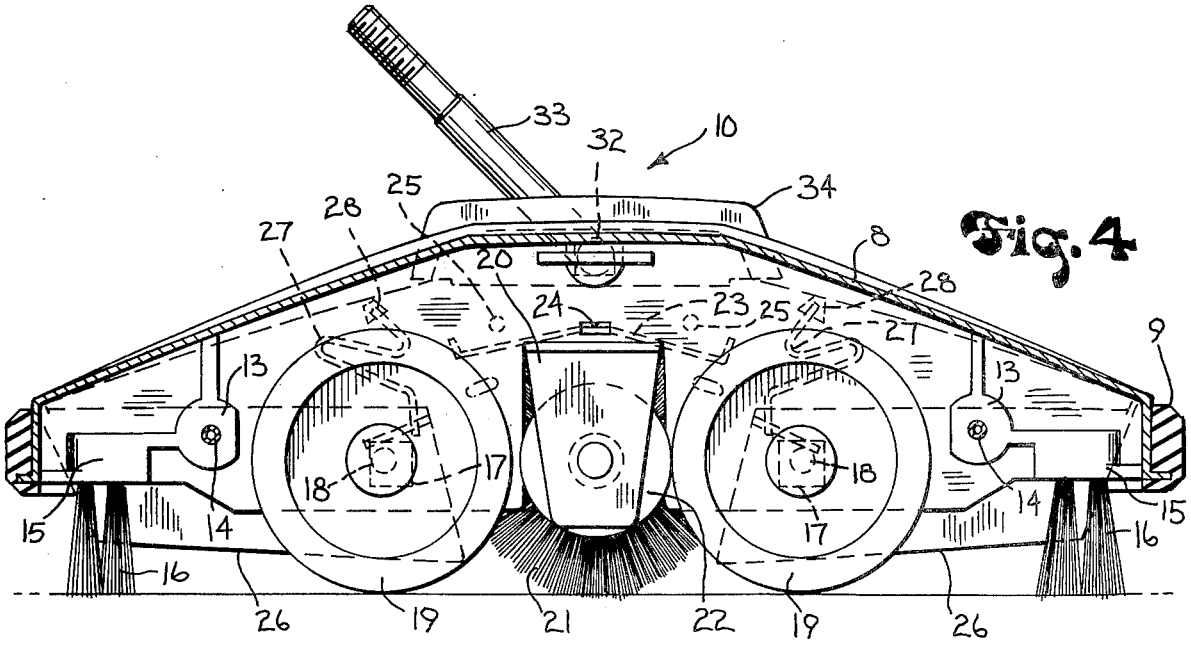
FIG. 4 is an end sectional view taken on line 4—4 of FIG. 3.

As shown in the drawings, the floor sweeper of the invention includes a handle 1 and a lower sweeping unit 2. Unit 2 comprises a rectangular unitary housing 3 having front and rear walls 4, 5, end walls 6, 7 and a top 8. A resilient bumper 9 extends around the periphery of the housing in the usual manner. Handle 1 is threadably connected to a bail and stay assembly 10 which extends through an elongated slot 11 in top 8, as will be more fully described hereinafter.

Housing 3 is adapted to mount substantially all of the functional working parts of the sweeper. For this purpose, a partition member 12 is spaced inwardly of each end wall 6,7 of the housing with each member 12 being provided with a pair of outwardly extending sleeve-like spacers 13 to which the housing end walls are secured, as by rivets 14. See FIG. 6 for a detail view of one partition member 12, the ends of which include flat bases 15 having downwardly depending brushes 16 which are disposed at the sweeper corners.

Each partition wall includes a pair of rectangular openings 17, with opposed openings receiving an axle 18 therethrough. Sweeper wheels 19 are suitably disposed on the ends of axles 18 and outwardly between the respective partition 12 and the housing end wall 6 or 7. Openings 17 are larger than axles 18 so that the latter may shift both horizontally and vertically.

Each partition 12 has a central outwardly and downwardly extending bracket 20 which is disposed between axle openings 17 and which also may serve as a spacer for the housing end walls 6 and 7. Brackets 20 serve as the end mounts for a roller brush assembly which includes the usual cylindrical brush 21 and end coupling wheels 22. A comb 23 extends between partitions 12 and is suitably mounted in slots 24 therein and between stops 25. The comb mounting means permits the comb to pivot slightly.

Each wheel axle 18 carries a dust pan 26 which is pivotable thereabout. Pans 26 are biased toward closed position by suitable springs 27 extending between the pan ends and retainers 28 on partitions 12. Springs 27 also function to bias the inner edges of pans 26 downwardly so that wheel axles 18 are normally biased against the lower edges of openings 17. When an assembly of an axle 18, wheels 19 and dust pan 26 are deflected upwardly due to downward pressure on sweeper handle 1, the axle raises in openings 17 and the inner pan lips raise to facilitate sweeping on long nap carpets.

Figure 5:
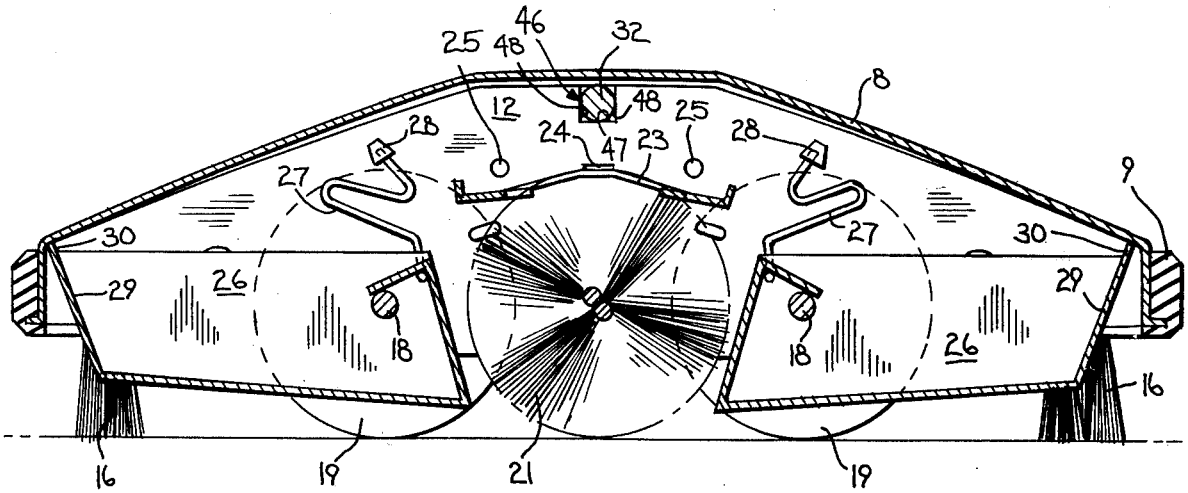
FIG. 5 is a central sectional view taken on line 5—5 of FIG. 3.

As best shown in FIG. 5, the outer walls 29 of pans 26 have terminal edges 30 at the top thereof. These edges are biased upwardly against sweeper housing top 8 by springs 27. As shown, top 8 is inclined forwardly and rearwardly from its midportion. This incline which is engaged by pan edges 30 when the pans are closed biases the pans, and thus wheels 19, toward coupling wheels 22 to tighten the engagement therebetween.

Figure 7:
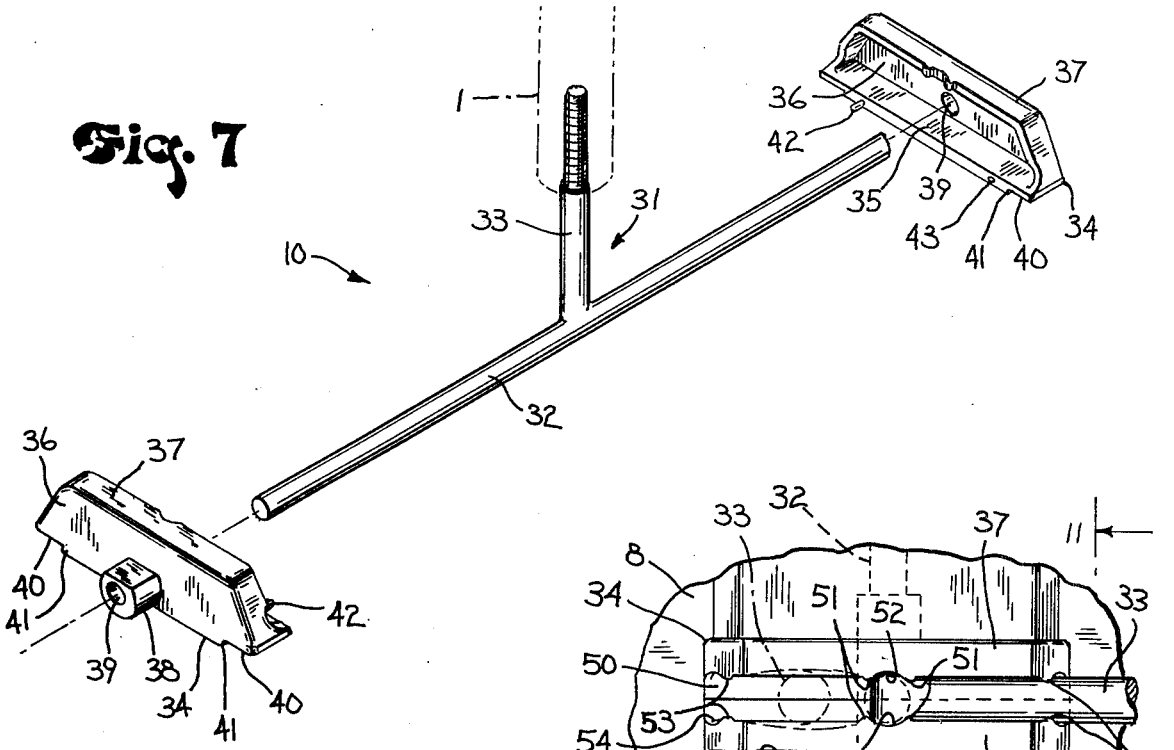
FIG. 7 is an exploded view of the T-bar bail and stay assembly.

Turning now to bail and stay assembly 10 and referring to FIG. 7, the assembly comprises a T-shaped bail 31 having a horizontal bar 32 and a central stud 33 extending laterally therefrom. Also forming part of the assembly is a bail stay formed by a pair of stay portions 34. Stay portions 34 are substantially identical and may be formed of a slightly flexible plastic elastomeric material. Each portion 34 comprises a flat base 35, an outer wall 36 extending upwardly from the outer base edge, and a lip 37 extending inwardly along the upper three sides of wall 36. Each lip 37 is narrower than the width of the respective base 35 and is generally parallel thereto. The end portions of lips 37 are slightly inclined. A bearing sleeve 38 extends outwardly from each wall 36 with an opening 39 extending through the sleeve and wall for tightly receiving bar 32.

The lower face of each base 35 is recessed, as at 40, thus forming shoulders 41. Furthermore, the inner edge of each base 35 is provided with a small pin 42 and hole 43 which are spaced apart.

Prior to assembling the entire sweeper mechanism, assembly 10 is formed by pressing opposing stay portions 34 onto the opposite ends of bail bar 32 and frictionally sliding them toward bail stud 33 until the edges of bases 35 engage, at which time portions 34 are disposed closely adjacent the stud. At the moment of mutual engagement of stay portions 34, pins 42 enter holes 43 in the opposite stay member, thus forming means to lock the two portions 34 against relative rotation on bar 32 prior to final mounting of the bail to housing 1.

Figure 8:
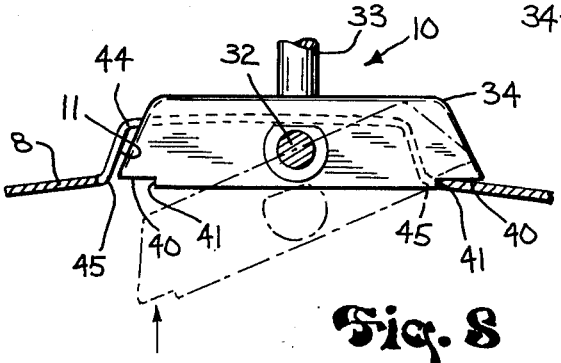
FIGS. 8 and 9 are fragmentary views showing the insertion of the bail and stay assembly through the slot in the sweeper top.
Figure 9:
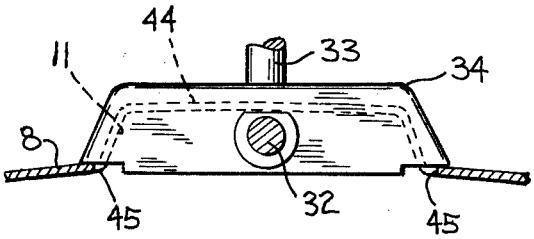

The assembly 10 is next mounted to the top 8 of empty housing 1. Referring to FIGS. 1, 8 and 9, top 8 is provided with a transversely extending raised portion 44 across which slot 11 extends. The central portion of assembly 10 is inserted from beneath top 8 so that bail stud 33 extends through slot 11 and so that the joined stay portions 34 extend angularly through the slot. The face of one recess 40 rides along the slot end edge 45, as in FIG. 8, until its shoulder 41 engages said edge. The length of the joined stay portions 34 is such that the opposite end may now be raised (see arrow) to a horizontal position. As shown in FIG. 9, the assembly is then slid sideways across the opposite end of the slot until both recess faces are resting on the portions of top 8 adjacent edges 45. In this position, assembly 10 is held in place by the friction of stay portions 34 against top 8, and the assembly is also locked against vertical movement relative to the general plane of the top. Walls 36 tightly engage the side edges of slot 11.

Subsequently, the remaining portions of the sweeper mechanism are assembled within housing 1, all of the parts being interconnected as heretofore described, and with rivets 14 holding partitions 12 in place.

Figure 6:
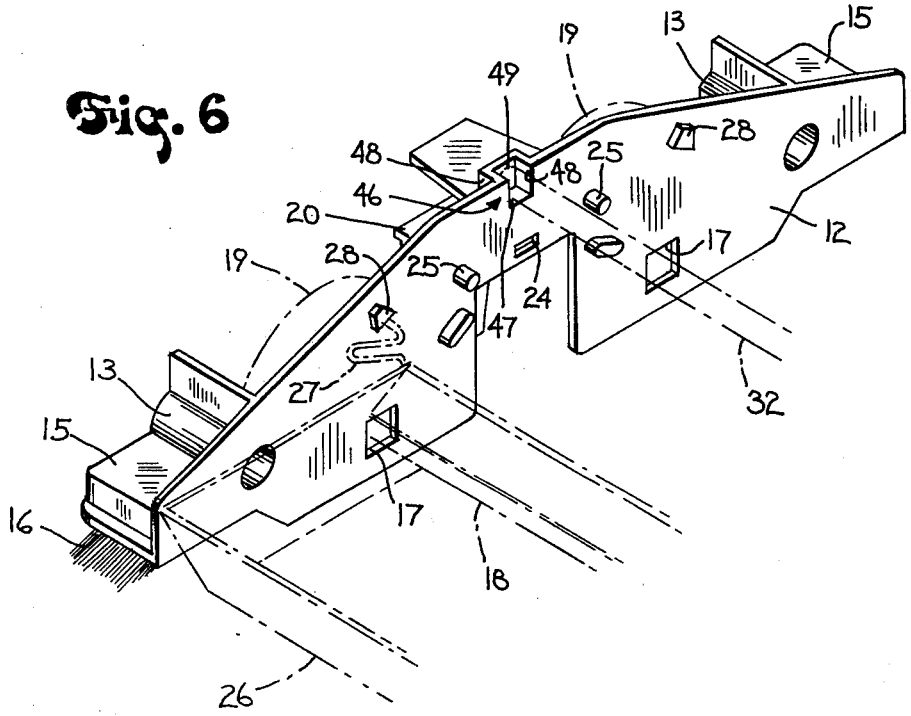
FIG. 6 is a perspective view of one of the sub-frame partitions.

Means are provided to lock the ends of bail bar 32 against lateral shifting which would tend to release stay portions 34 from slot 11, and also to lock bar 32 against axial shifting in stay portion openings 39. For this purpose, and as best shown in FIGS. 3 and 6, the central edge portion of each partition 12 which is disposed closely adjacent top 8 is provided with a slot 46 having a bottom wall 47, side walls 48 and an end wall 49. The ends of bar 32 are received in slots 46 when the mechanism is fully assembled.

The pair of facing side walls 48 of the two partitions lock bar 32 and thus bail and stay assembly 10 against lateral shifting. Members 34 cannot shift lengthwise in slot 11.

In addition, slot 11 and members 34 lock bar 32 against any axial shifting so that it cannot slide in openings 39.

In some instances, it might be possible for one or more partitions 12 to tend to come loose, as when rivets 14 loosen due to wear or other factors. In such case, partitions 12 might tend to shift or flex inwardly and bind the working sweeper parts against free operation. The engagement of the bail bar ends with the partition end walls 49 provides a means which locks the partition against such inward movement. In fact, such engagement tends to help prevent rivets 14 from loosening.

Figure 10:
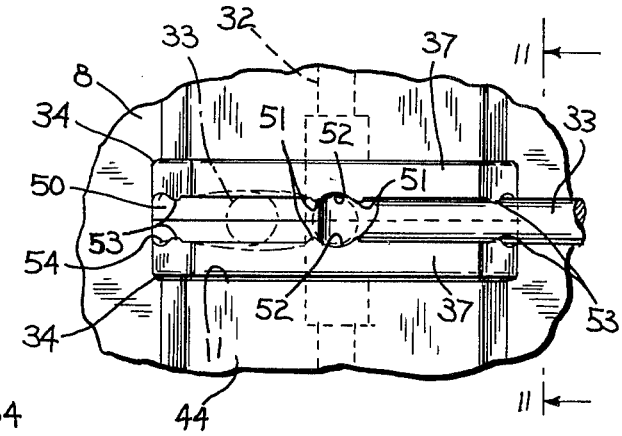
FIG. 10 is a fragmentary top plan view showing the bail stud in several positions.
Figure 11:
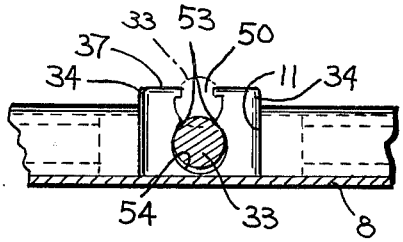
FIG. 11 is a fragmentary end view of the stay taken on line 11—11 of FIG. 10 and showing the bail stud positioned in one of the end detents.

Turning now to further details of bail and stay assembly 10, and referring primarily to FIGS. 3, 10 and 11, the opposing bail stay portions 34 form an elongated guide channel 50 therebetween by virtue of the fact that lips 37 are narrower than base portions 35. Each lip edge forms one side of the channel. The construction is such that dirt and other debris cannot readily penetrate through housing slot 11 and downwardly into the sweeper mechanism. Walls 36 are in relatively tight engagement with the slot edges, and dirt cannot penetrate beyond channel 50.

Bail stud 33 extends outwardly from channel 50 and is adapted to rotate about the axis of bail bar 32 to suitably position handle 1 relative to sweeper housing 3. It is desirable to provide multiple stops or detents to hold bail stud 33 and therefore handle 1 in inclined or upright positions. For this purpose, the mutually facing edges of lips 37 are provided with centrally disposed pairs of spaced detent projections 51, between which are formed arcuate edge portions 52. As shown in FIG. 10, the facing portions 52 form a generally circular middle stay for stud 33 with said stay being at least equal to or larger in diameter than the diameter of the stud. Thus, when stud 33 is positioned uprightly, it will be slightly loose and will not flex lips 37 outwardly during storage to possibly give members 34 an undesirable permanently expanded set.

In addition, and referring to FIGS. 10 and 11, the end portions of channel 50 are slightly restricted by facing detent projections 53 on lips 37 and which merge outwardly into arcuate edge portions 54 which form a generally circular end stay for stud 33, with this stay also being at least equal to or greater in diameter than the diameter of the middle stay for the same reasons. While two sets of end detents have been disclosed herein, it may be desirable to utilize only one such end detent.

Furthermore, and as best seen in FIG. 10, the width of channel 50 is slightly less than the diameter of bail stud 33. Thus, as stud 33 is moved between the detents and/or held in a generally angular position during sweeping, the edges of lips 37 will be forced outwardly by the stud body and will bind against the side of the stud body walls. This tends to frictionally hold the sweeper body in relatively tight frictional engagement at a particular angle with stud 33 so that the body will resist forces during sweeping which tend to cause the body to wobble about the transverse horizontal axis of bail rod 32 during sweeping.

Various modes of carrying out the invention are contemplated as being within the scope of the following claims particularly pointing out and distinctly claiming the subject matter which is regarded as the invention.

I claim:

1. In a floor sweeper:

(a) a lower housing having end walls and a top and with said housing mounting sweeping mechanism therewithin, (b) an elongated slot disposed centrally of said top, (c) and a bail and stay assembly mounted to said top and extending upwardly through said slot, said assembly comprising:

(1) a T-shaped bail having a horizontal bail bar and a handle receiving bail stud extending laterally from the central portion of said bar and upwardly through said slot, (2) and a flexible bail stay comprising a pair of facing stay portions tightly receiving said bar therethrough and forming an elongated channel through which said bail stud extends.

2. The floor sweeper of claim 1 wherein each of said stay portions comprises:

(a) a flat base, (b) an outer wall extending upwardly from said base and tightly engaging the side edges of said slot, (c) and a lip extending inwardly along the sides of said wall, (d) said lip being narrower than the width of said base and having an edge which forms one side of said channel.

3. The floor sweeper of claim 1 or 2:

(a) which includes detent means disposed centrally of and at at least one end of said channel, (b) said detent means including inwardly facing projections and arcuate edges adjacent said projections to form stays for said bail stud, (c) the diameter of said arcuate edges being at least as great as the diameter of said bail stud.

4. The floor sweeper of claim 3 wherein the width of said channel between said detent means is less than the diameter of said bail stud to thereby grip and frictionally hold the side of said stud.

5. The floor sweeper of claim 1 or 2:

(a) which includes multiple detent means spaced along said channel for holding said stud in a desired position relative to said housing, (b) the facing edges of said channel between said detent means being spaced apart a distance less than the diameter of said bail stud to thereby grip and frictionally hold the side of said stud.

6. The floor sweeper of claim 1 which includes means to lock said facing stay portions against relative rotation on said bail bar.

7. The floor sweeper of claim 6 wherein said locking means comprises cooperative pin and pin-receiving hole means on said facing stay portions.

8. The floor sweeper of claim 1:

(a) wherein said bail stay extends beyond the ends of said slot, (b) and said slot comprises means to lock said assembly against vertical movement relative to said top.

9. The floor sweeper of claim 1 which includes means to lock said bail bar against axial movement relative to said bail stay.

10. The floor sweeper of claim 1 or 9 which includes means to lock said bail stay against lengthwise movement in said slot.

11. The floor sweeper of claim 1:

(a) which includes a sub-frame disposed within said housing and with said sub-frame including a pair of partitions spaced inwardly from the respective housing end walls, (b) and slots disposed in said partitions and receiving the end portions of said bail bar.

12. The floor sweeper of claim 11 wherein said last-named slots form means to lock said bail stay against lengthwise movement in said first-named slot in said top.

13. The floor sweeper of claim 11 wherein the ends of said bar comprise means to lock said partitions against moving inwardly relative to said housing ends.

14. In a floor sweeper:

(a) a lower housing having end walls and a top and with said housing mounting sweeping mechanism therewithin, (b) an elongated slot disposed centrally of said top, (c) a bail and stay assembly mounted to said top and extending upwardly through said slot, said assembly comprising:

(1) a T-shaped bail having a horizontal bail bar and a handle receiving bail stud extending laterally from the central portion of said bar and upwardly through said slot, (2) and a flexible bail stay comprising a pair of facing stay portions receiving said bar therethrough and forming an elongated channel through which said bail stud extends, (d) and spaced detent means disposed along said channel, (e) the facing edges of said channel between said detent means being spaced apart a distance less than the diameter of said bail stud to thereby grip and frictionally hold the side of said stud.

15. In a floor sweeper:

(a) a lower housing having end walls and a top and with said housing mounting sweeping mechanism therewithin, (b) an elongated slot disposed centrally of said top, (c) a bail and stay assembly mounted to said top and extending upwardly through said slot, said assembly comprising:

(1) a T-shaped bail having a horizontal bail bar and a handle receiving bail stud extending laterally from the central portion of said bar and upwardly through said slot, (2) and a flexible bail stay comprising a pair of facing stay portions receiving said bar therethrough and forming an elongated channel through which said bail stud extends, (d) and means to lock said facing stay portions against relative rotation on said bail bar.

16. In a floor sweeper:

(a) a lower housing having end walls and a top and with said housing mounting sweeping mechanism therewithin, (b) an elongated slot disposed centrally of said top, (c) a bail and stay assembly mounted to said top and extending upwardly through said slot, said assembly comprising:

(1) a T-shaped bail having a horizontal bail bar and a handle receiving bail stud extending laterally from the central portion of said bar and upwardly through said slot, (2) and a flexible bail stay comprising a pair of facing stay portions receiving said bar therethrough and forming an elongated channel through which said bail stud extends, (d) said slot and said stay portions forming means to lock said bail against axial movement relative to said bail stay.

17. In a floor sweeper:

(a) a lower housing having end walls and a top and with said housing mounting sweeping mechanism therewithin, (b) an elongated slot disposed centrally of said top, (c) a bail and stay assembly mounted to said top and extending upwardly through said slot, said assembly comprising:

(1) a T-shaped bail having a horizontal bail bar and a handle receiving bail stud extending laterally from the central portion of said bar and upwardly through said slot, (2) and a flexible bail stay comprising a pair of facing stay portions receiving said bar therethrough and forming an elongated channel through which said bail stud extends, (d) and means to lock said bail stay against lengthwise movement in said slot.

18. In a floor sweeper:

(a) a lower housing having end walls and a top and with said housing mounting sweeping mechanism therewithin, (b) an elongated slot disposed centrally of said top, (c) a bail and stay assembly mounted to said top and extending upwardly through said slot, said assembly comprising:

(1) a T-shaped bail having a horizontal bail bar and a handle receiving bail stud extending laterally from the central portion of said bar and upwardly through said slot, (2) and a flexible bail stay comprising a pair of facing stay portions receiving said bar therethrough and forming an elongated channel through which said bail stud extends, (d) said slot and said stay portions forming means to lock said bail against axial movement relative to said bail stay, (e) and means to lock said bail stay against lengthwise movement in said slot.

19. The floor sweeper of claim 18:

(a) which includes a sub-frame disposed within said housing and with said sub-frame including a pair of partitions spaced inwardly from the respective housing and walls, (b) and slots disposed in said partitions and receiving the end portions of said bail bar, (c) said last-named slots holding the end portions of said bail bar to form said last-named means.

20. The floor sweeper of claim 19 wherein the ends of said bar comprise means to lock said partitions against moving inwardly relative to said housing ends.

* * * * *